US005238279A

United States Patent [19]

Anteau

[11] Patent Number: 5,238,279

[45] Date of Patent: Aug. 24, 1993

[54] ENCAPSULATED SLING

[76] Inventor: Paul D. Anteau, 413 Erie St., Woodville, Ohio 43469

[21] Appl. No.: 857,773

[22] Filed: Mar. 26, 1992

[51] Int. Cl.[5] ..... B66C 1/12

[52] U.S. Cl. ..... 294/74

[58] Field of Search ..... 294/74

[56] References Cited

U.S. PATENT DOCUMENTS

| | | | |
|---|---|---|---|
| 3,290,083 | 12/1966 | Norton | 294/74 |
| 3,622,025 | 11/1971 | Petersen . | |
| 3,923,171 | 12/1975 | Pragnell et al. | 294/74 X |
| 4,022,507 | 5/1977 | Marino | 294/74 |
| 4,052,095 | 10/1977 | Johnson | 294/74 |
| 4,232,619 | 11/1980 | Lindahl | 294/74 X |
| 5,037,237 | 8/1991 | Anteau . | |

*Primary Examiner*—Joseph D. Pape

*Attorney, Agent, or Firm*—Willian Brinks Olds Hofer Gilson & Lione

[57] ABSTRACT

An encapsulated sling including a sling formed in one piece or in multiple pieces or sections joined end to end by a pin at a juncture between adjacent ends, the sling having a spaced apart pair of eyes adjacent its opposed ends to permit the sling to be suspended from a hoist or other structure and possibly one or more intermediate eyes between its ends to permit the suspended length of the sling to be reduced, the sling being surrounded by a sleeve fabricated from a flexible, polymeric material, such as PVC or a PVC coated material, which covers the entire length of the sling between its eyes, including the edges of the slings. The sleeve further comprises pockets positioned to cover the top and bottom surfaces of the eyes. In a multiple piece sling, the protective sleeve is formed in end to end sections, each of which covers one of the sections of the sling to permit the joined sling sections to be unjoined, and the encapsulated sling is further provided with a slidable sleeve which surrounds the protective sleeve and which is slidable therealong to cover the juncture between adjacent sling sections and adjacent protective sleeve sections during the use of said sling.

13 Claims, 3 Drawing Sheets

ENCAPSULATED SLING

BACKGROUND OF THE INVENTION

1. Field Of The Invention

This invention relates to a sling for use in hoisting boats or other heavy objects. More particularly, this invention relates to a sling of the foregoing character which is encapsulated with suitable protective elements to prevent the sling from being damaged by ultraviolet light and/or by dirt and gravel and other abrasive substances that the sling can contact during its normal use, and to prevent or substantially prevent the sling from damaging the surfaces of the objects it is used to hoist.

2. Description Of The Prior Art

My prior U.S. Pat. No. 5,037,237, the disclosure of which is hereby incorporated by reference, describes the use of slings in hoisting a boat, and discusses the problems of contact damage that can be caused to a boat during hoisting by dirt or gravel or other debris that can be picked up by a sling, especially a sling of a coarse texture. The aforesaid U.S. Pat. No. 5,037,237 solves such problems by teaching the use of separate protectors releasably affixed to the lifelines or other elements of the boat and positioned between the hull of the boat and each of the slings used to hoist the boat to thereby prevent such contact damage. However, many marinas are reluctant to use protectors of the type taught in the aforesaid U.S. Pat. No. 5,037,237, because the affixing of the protectors to the boat prior to the hoisting operation, and the removal of the protectors after the hoisting operation, slows down the hoisting operation and therefore at least somewhat increases the initial expense to the marina in conducting its hoisting operations.

While the use of protectors according to the aforesaid U.S. Pat. No. 5,037,237 is quite effective in preventing contact damage to a boat or other hoisted object from debris carried by a sling, it does not protect the sling from abrasion or other contact damage caused by the initial and subsequent relative motion and other contact between the sling and such debris, which can materially shorten the useful life of a sling relative to that of a comparable sling which is not suitably protected from such contact. Further, many slings are woven from polyester or polyamide (Nylon) or other ultraviolet light sensitive materials, and ultraviolet light degradation of such slings can also materially shorten the life of such slings, especially those used in Southern states of the United States and in other locations having similar climatic conditions. U.S. Pat. No. 3,622,025 (Peterson) teaches the use of pads to protect a boat sling from damage by contact with fittings on the hulls of hoisted boats. However, the protective pads of this reference are too short and too narrow to protect the eyes and the edges of a sling from the kinds of damage that can occur when a sling is dragged across rough terrain and do not protect enough of the length of the sling to effectively retard ultraviolet light degradation of slings made from light sensitive materials.

SUMMARY OF THE INVENTION

According to the present invention there is provided a sling which is encapsulated by one or more suitable flexible protective elements, preferably throughout the entire length of the sling including its eyes at its opposed ends and any extra, intermediate eyes. The protective elements of the sling of the present invention protect the encapsulated sling, including its eyes and edges, from contact damage with the ground and the objects to be hoisted by the sling, and further protect the sling from damaging exposure to ultraviolet light. Such protective elements, which are preferably fabricated from a flexible polymeric material with a smooth, product engaging surface, such as polyvinyl chloride (PVC) or a PVC coated fabric or other material, can be readily removed and reattached to permit frequent inspection of the encapsulated sling to ensure that it is still suitable for use, as is required by many health and safety codes and regulations. Further, the smoothness of the product engaging surface of the protective elements of the slings helps to prevent debris from accumulating on such surface, and further simplifies the removal of any accumulated debris by shaking or rinsing or the like, and thereby helps to prevent or minimize contact damage to the boat or other hoisted object.

Accordingly, it is an object of the present invention to provide an improved sling for use in hoisting boats or other heavy objects. More particularly, it is an object of the present invention to provide a sling of the foregoing character which is more resistent to life shortening contact with external debris and other objects and/or which is more resistent to life shortening exposure to ultraviolet radiation. It is also an object of the present invention to provide a sling of the foregoing character which is less likely to cause contact damage to the external surfaces of the objects that are hoisted by such sling.

For a further understanding of the present invention and the objects thereof, attention is directed to the drawings and the following brief descriptions thereof, to the detailed description of the preferred embodiment, and to the appended claims.

DETAILED DESCRIPTION OF THE PREFERRED EMBODIMENT

Figure 2:
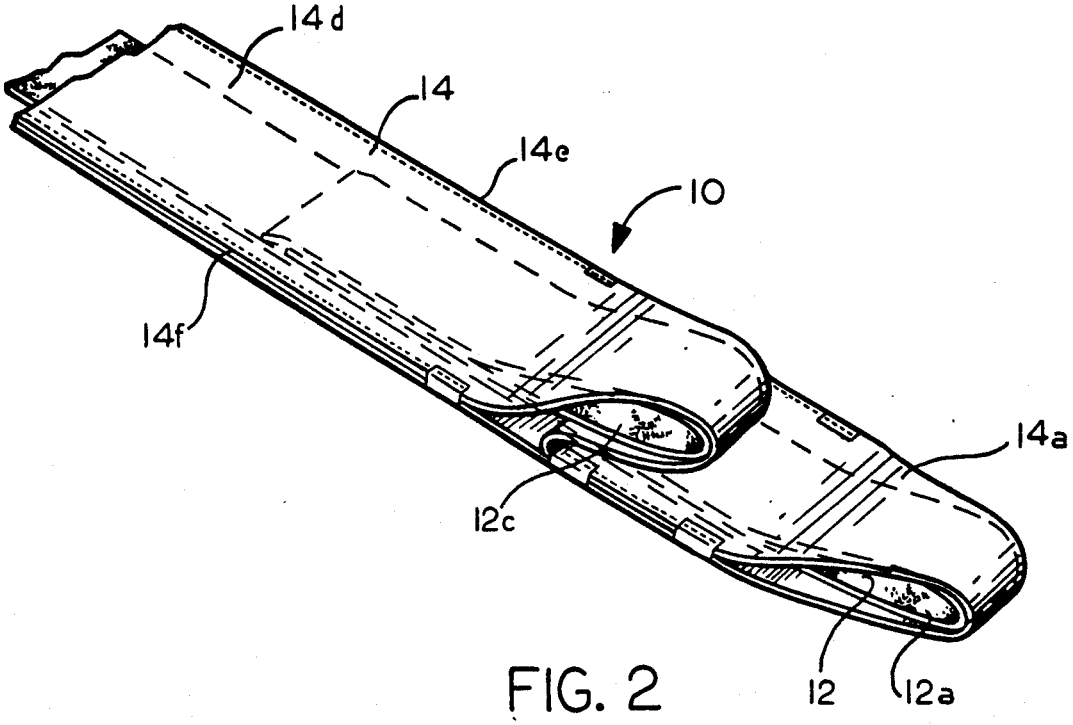
FIG. 2 is a fragmentary perspective view, at a somewhat enlarged scale, of a portion of the encapsulated sling of FIG. 1.
Figure 1:
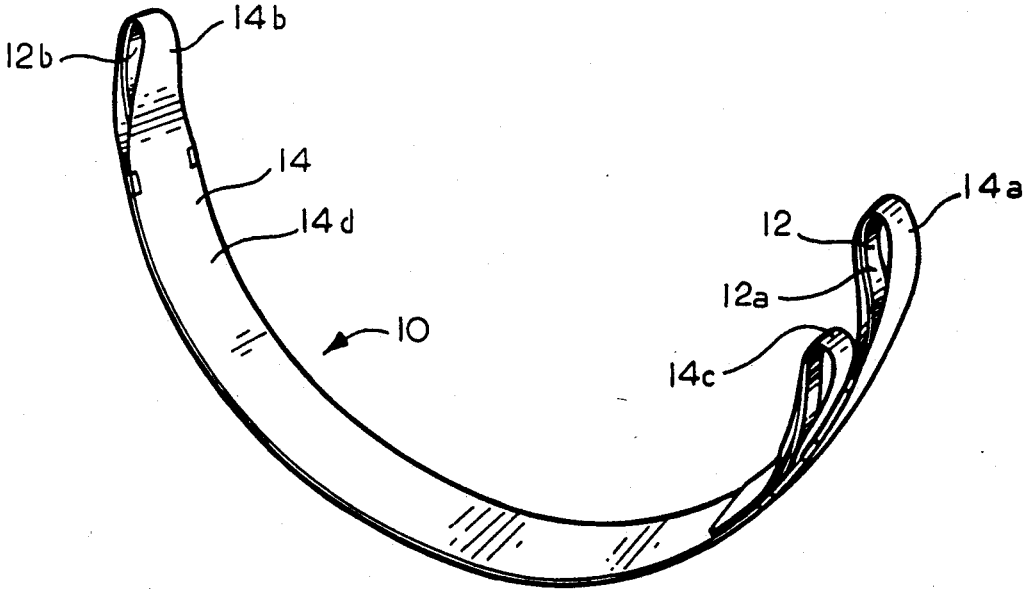
FIG. 1 is a perspective view of an encapsulated sling according to a preferred embodiment of the present invention.

An encapsulated sling according to the preferred embodiment of the present invention is indicated generally by reference numeral 10 in FIGS. 1 and 2. The encapsulated sling 10 is made up of an otherwise conventional woven fabric or polyester load bearing sling 12 surrounded or encapsulated by a protective sleeve 14, preferably of a non-load bearing character. As illustrated, the sling 12 is manufactured in one piece and is provided with an opposed pair of open ends or eyes **12*a*, 12*b* by which the sling 10 may be suspended from attachments of a traveling hoist, not shown, or from any other suitable structure. As is known, prior art slings are usually used in pairs with a spacing between the slings in each pair for proper positional stability of the load during hoisting, and it is recommended that encapsulated slings 10 be used in such a manner. In any case, the sling 12 may also be provided with one or more additional eyes between its opposed ends 12***a*, 12*b*, such as the eye 12*c*, by which the length of the sling 10 that is suspended between the attachments of a hoist can be shortened.

The protective sleeve 14 is fabricated from a flexible material with at least an inner, product contacting surface 14*d* which is quite smooth and resistent to the accumulation of dirt, gravel or other abrasive debris thereon and/or which is more resistant to attack by grease or other chemicals than the material of the sling 12. The flexible material of the protective sleeve 14 is somewhat wider than the width of the sling 12, and the sling 12 is positioned generally centrally between the edges of the sleeve 14, which are then joined to the underlying edges of a like or doubled back portion of the flexible material along the edges 14*e*, 14*f* at locations external to the edges of the sling 12. When the sleeve 14 is formed from a single, doubled back length of flexible material, its opposed ends are preferably joined to one another in an overlapped seam. When the sleeve 14 is formed from two or more plys or lengths of flexible material, the lengths are preferably joined in an end to end manner with a lapped seam between adjacent ends of adjacent lengths. In any case, while the joining along the edges 14*e*, 14*f* is preferably relatively permanent to minimize the cost of the encapsulated sling 10, it is also contemplated that seams along the edges 14*e*, 14*f* can be formed with Velcro hook and loop elements or other readily openable and reclosable joining material, for example, to permit rapid and repeated inspection of the sling 12 to ensure that it is still fit for service. In any case, the protective sleeve 14 is provided with pockets 14*a*, 14*b*, 14*c* which surround the eyes 12*a*, 12*b*, 12*c*, respectively, of the sling 12, and serve to prevent substantial relative longitudinal movement without requiring excessively close clearance therebetween.

The protective sleeve 14, thus, protects all portions of the sling 12, including the eyes 12*a*, 12*b*, 12*c* and the opposed edges of the sling between the pockets 12*b*, 12*c* and 12*c*, 12*a*, from abrasion or other contact damage. Such contact damage can be quite limiting of the useful life of the sling 12 and can occur, for example, when an unprotected sling 12 or at least an end portion thereof is dragged across the ground, paved or unpaved, in a marina or other commercial or industrial job site where slings are frequently used. Such an action can be especially damaging to the eyes of an unprotected sling due to their protruding character and to the edges of an unprotected sling. Further, many slings are formed by weaving polyester or polyamide (Nylon) or other materials which are subject to degradation when exposed to ultraviolet light. Such ultraviolet light degradation can be particularly limiting to the useful life of slings used in Southern states of the United States or in other locations with similar climatic conditions, and is effectively retarded by the use of a protective sleeve 14. Further yet, the inclusion of the eyes 12*a*, 12*b*, 12*c* within the sleeve 14 precludes any substantial relative movement between the sling 12 and the sleeve 14 and thereby ensures that no portion of the hoisted object will be in direct, load bearing contact with any portion of the sling 12.

The protective sleeve 14 is preferably formed by fabrication from a flexible, polymeric material with a smooth, product engaging surface 14*d* to resist the accumulation of abrasive debris thereon, and to facilitate the removal of debris therefrom by rinsing, shaking or the like, to thereby prevent or minimize contact damage to a boat or other heavy object when hoisted by the sling 10. Polyvinyl chloride (PVC) in sheet form or as a coating on or lamination to fabric or on an expanded PVC or polyethylene sheet is well suited in its flexibility, surface smoothness, resistance to surface abrasion damage and ultraviolet light degradation, and cost for such usage, and the overlapping edges of adjacent sheets or layers of a sheet can be readily joined to one another by stitching. Further, such fabrics have sufficient flexibility to facilitate the relatively rapid assembly and disassembly of the sling 12 and the sleeve 14, at least in widths of the sling 12 up to approximately 8 inches, by folding over a pocket at one end of the sleeve 14, for example, the pocket 14*a*, to permit the end 12*b* of the sling 12 to be inserted into the opening adjacent the pocket 14*a* and the sling 12 threaded through the sleeve 14 until the end 12*b* is received in its pocket 14*b*. Thus, the sling 12 and the protective sleeve 14 may be readily disengaged to permit a visual inspection of the sling 12 to ensure that it is still fit for its intended usage, as is required by many health and safety codes. When the PVC sheeting is used in conjunction with an expanded or foamed backing material, such as expanded PVC or polyethylene, the backing material will provide a cushioning effect which will help to protect the surface of the hoisted object from contact damage by irregularities on the encapsulated sling 10 and will help to protect the sling 12 from such damage by irregularities on the hoisted object.

Figure 3:
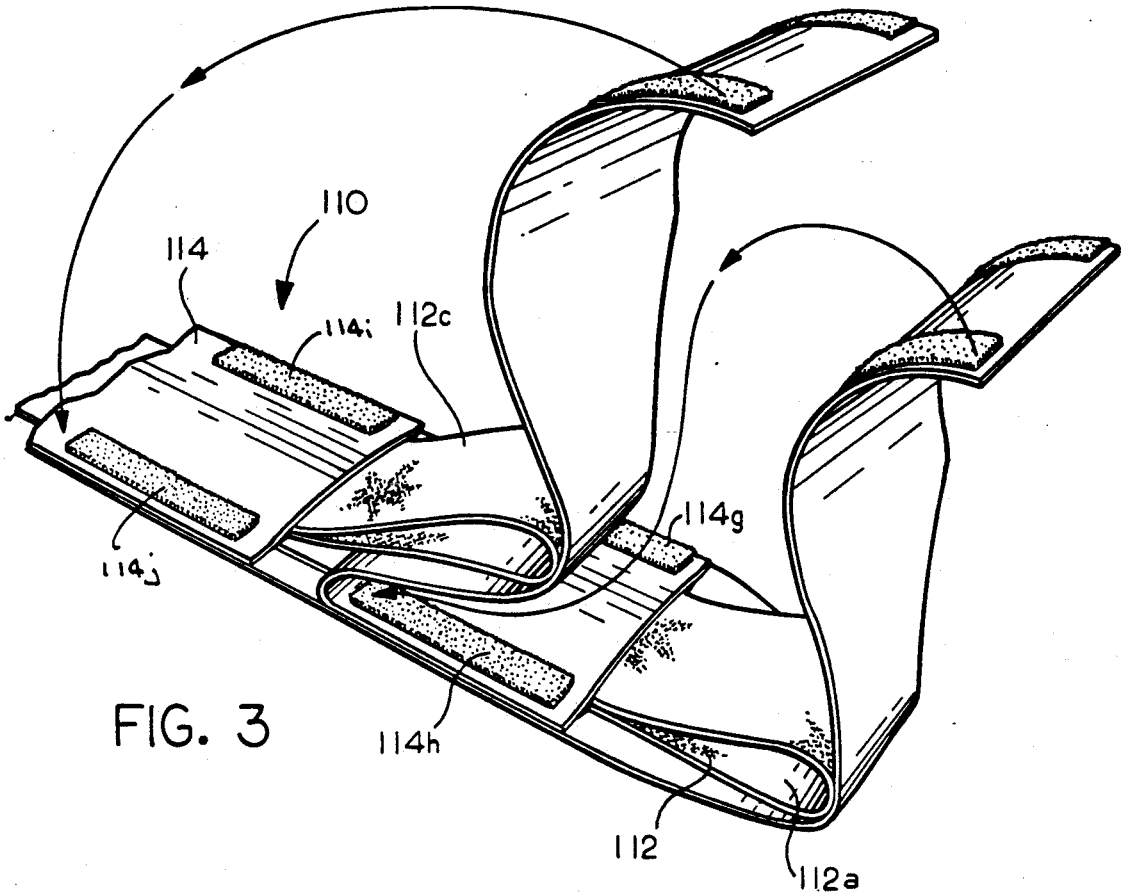
FIGS. 3 and 4 are views similar to FIG. 2 of an alternative embodiment of an encapsulated sling according to the present invention in different stages of the assembly of such sling.
Figure 4:
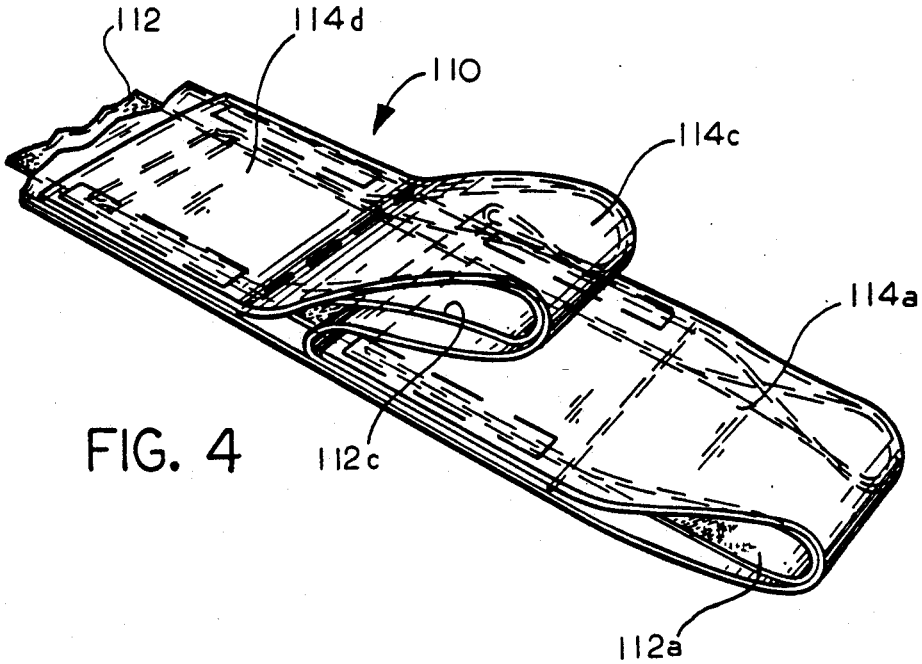

FIGS. 3 and 4 illustrate an alternative embodiment of an encapsulated sling according to the present invention in which elements that correspond to elements of the embodiment of FIGS. 1 and 2 are identified by 100 series reference numerals, the last two digits of which are the same as the two digits of the corresponding elements of the embodiment of FIGS. 1 and 2, if any. The embodiment of FIGS. 3 and 4 is designed for situations where it is not possible to fold over a pocket of the protective sleeve to insert a sling into the protective sleeve, as described above, for example, in the case of wide slings, such as slings with the width greater than approximately 8 inches, or in the case of a protective sleeve which is fabricated from a relatively bulky material. Thus, FIGS. 3 and 4 illustrate an encapsulated sling which is generally identified by reference numeral 110 and which is made up of a load bearing sling 112 and a protective sleeve 114, preferably of a non-load bearing character, which surrounds or encapsulates the sling 112.

The end portion of the sling 112 that is illustrated in FIGS. 3 and 4 has an eye 112*a* at the outer end thereof, and may also be provided with one or more inner eyes, such as the eye 112*c*, it being understood that the opposite end portion of the sling 112 that is not illustrated will also be provided with at least one eye. Pockets 114*a*, 114*c* are provided in the protective sleeve 114 for receiving the eyes 112*a*, 112*c*, respectively, and are formed by releasably joining overlapping portions of the material which is used in the fabrication of the sleeve 114. Velcro hook and eye strips 114*g*, 114*h* are applied to the edges of the sleeve 114 in the region of the pocket 114*a* to facilitate rapid opening and reclosing of the pocket 114*a*. Similarly, Velcro hook and loop strips 114*i*, 114*j* are applied to the edges of the sleeve 114 in the region of the pocket 114*c* to facilitate rapid opening and closing of the pocket 114*c*. It is to be noted that the pockets 114*a*, 114*c* open in the direction faced by the product contacting surface 114*d* of the protective sleeve 114 so that the pockets 114*a*, 114*c* will have maximum resistance to inadvertent opening during the hoisting of an object. In any case, the protective sleeve 114 is fabricated from a flexible, polymeric material with a smooth, product engaging surface 114*d* from a suitable flexible, polymeric material, such as any of the materials described above in relation to the fabrication of the protective sleeve 14.

Figure 6:
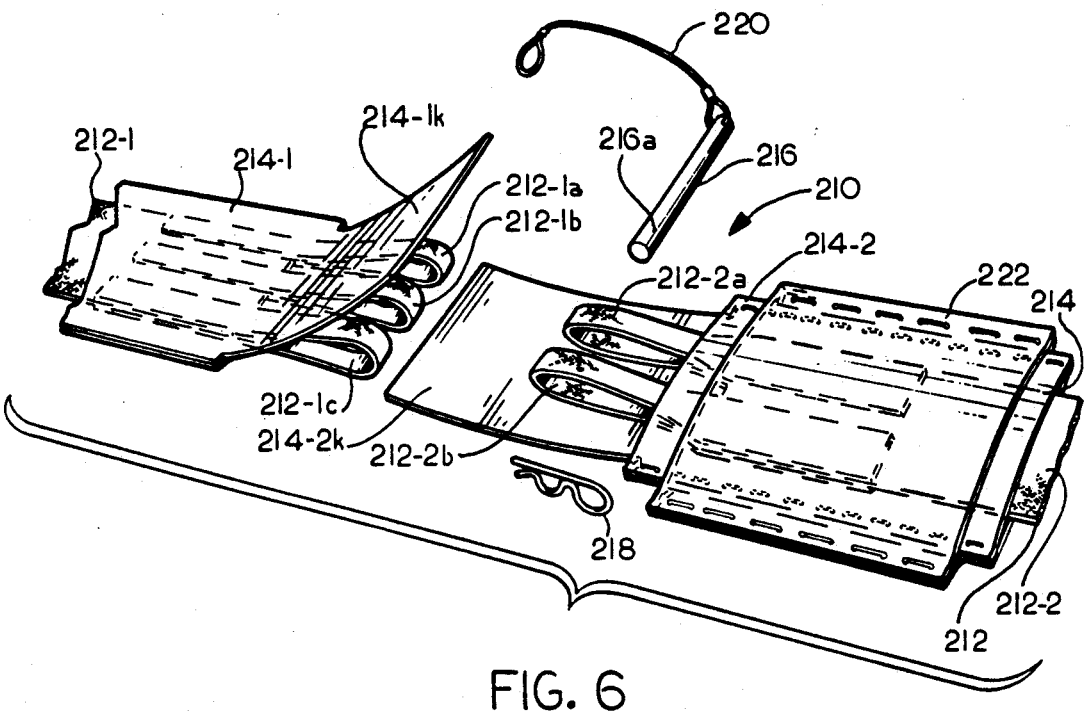
FIG. 6 is a fragmentary view of the encapsulated sling of FIG. 5 illustrating a step in the assembly of such encapsulated sling.
Figure 5:
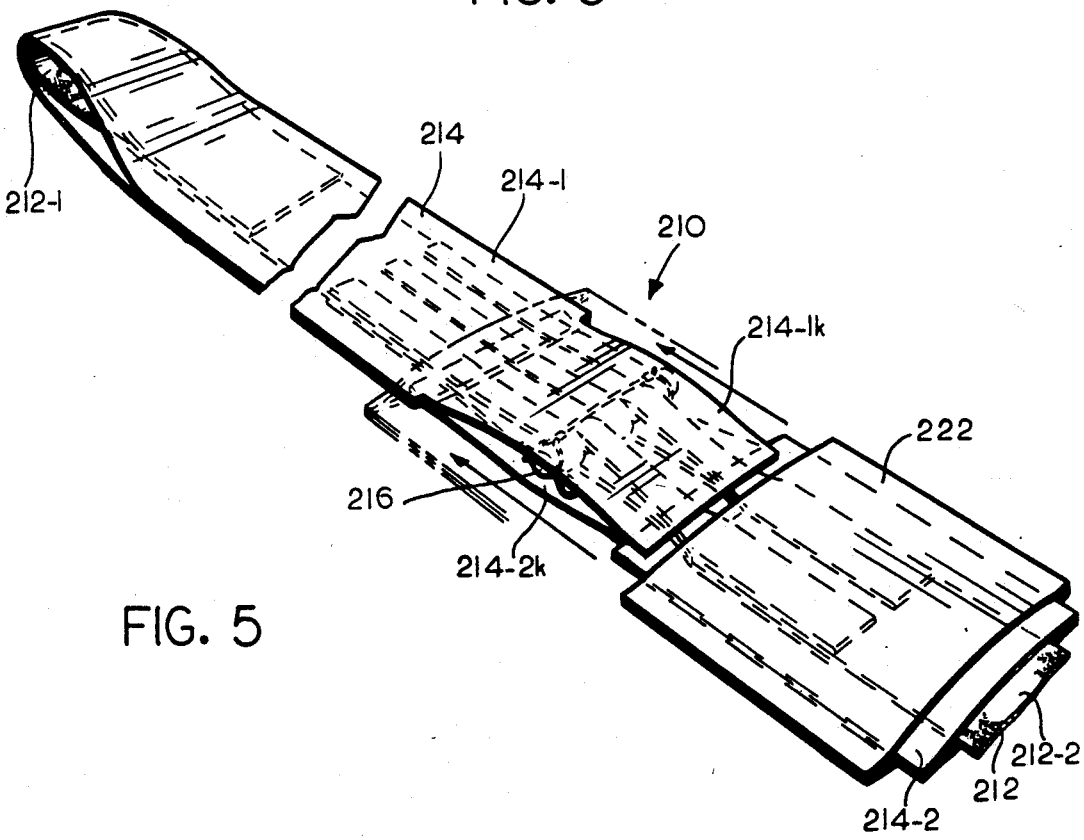
FIG. 5 is a partly exploded view similar to FIG. 2 of an alternative embodiment of an encapsulated sling according to the present invention.

FIGS. 5 and 6 illustrate an alternative embodiment of an encapsulated sling according to the present invention in which the elements that correspond to elements of the embodiment of FIGS. 1 and 2 are identified by 200 series reference numerals, the last two digits of which are the same as the two digits of the embodiment of FIGS. 1 and 2, if any. The embodiment of FIGS. 5 and 6 is designed for application to multiple piece slings where a single sling is formed by releasably joining two or more sections of a sling in end to end fashion. Slings of this general type are known in the art, as is disclosed, for example, in the aforesaid U.S. Pat. No. 3,622,025.

Thus, FIGS. 5 and 6 illustrate an encapsulated sling which is generally identified by reference numeral 210 and which is made up of a load bearing sling 212 and a protective sleeve 214 that surrounds or encapsulates the sling 212. The sling 212 is made up of individual sling sections 212-1, 212-2 which are disengagably joined to one another by a pin 216 that extends through interleaved loops 212-2*a*, 212-2*b* of the section 212-2, and 212-1*a*, 212-1*b*, 212-1*c* of the section 212-1. The pin 216 is releasably retained within the loops of the sling sections 212-1, 212-2 by a cotter pin 218 that extends through an opening 216*a* in the pin 216 near an end thereof. The pin 216 also has a locking loop 220 tethered to an end thereof, which is opposed to the end carrying the opening 216*a*. The free end of the loop 220 is interlocked with the cotter pin 218 to help secure the pin 216 and the interleaved loops of the sections 212-1, 212-2 through which it is passed.

Because of the multi-piece character of the sling 212, the protective sleeve 214 is fabricated in multiple sections corresponding to the sections in the sling 212, namely protective sleeve sections 214-1, 214-2 in the case of a sling that is made up of sling sections 212-1, 212-2. The sleeve sections 214-1, 214-2 are fabricated from a suitable flexible material, such as any of the flexible materials described above in relation to the sleeve 14 as described above or by a similar fabrication method.

For accessibility to the pin 216 to couple or uncouple the sling sections 212-1, 212-2, the plys of the flexible material used in the fabrication of the sleeve sections 214-1, 214-2 have free ends 214-1*k*, 214-2*k* on opposed sides of the sling sections 212-1, 212-2. Thus, as is shown in FIG. 5, after the sling sections 212-1, 212-2 are joined by the pin 216, the free ends 214-1*k*, 214-2*k* are folded down to closely overlie the sling sections 212-1, 212-2, but may readily be folded back to permit coupling or uncoupling of the sling sections 212-1, 212-2, as is shown in FIG. 6. The sling 210 is further provided with a relatively short sleeve 222 which slidably surrounds the sleeve 214. The sleeve 222, which is also formed from a pair of layers of suitable flexible material by stitching the opposed edges of the layers to one another, is movable to surround the free ends 214-1*k*, 214-2*k* of the sleeve sections 214-1, 214-2 to hold them in place during the normal use of the encapsulated sling 210, and to protect the portions of the sling 212-1, 212-2 that would otherwise be exposed to contact and ultraviolet light damage. However, the sleeve is also movable away from such free ends to permit ready access to the pin 216. Because the extra thickness of the sling 212 in the region of the joint between the adjacent ends of the sections 212-1, 212-2, the sleeve 222 can and should be sized to fit rather snugly in this region to be resistant to inadvertent movement during the use of the sling 210 and will still have sufficient clearance with respect to other portions of the sleeve sections 214-1, 214-2 to be freely movable with respect thereto.

Although the best mode contemplated by the inventor(s) for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. An encapsulated sling comprising:

an elongate sling formed from a relatively coarse, load bearing material and having at least a pair of longitudinally spaced apart eyes by which the sling may be suspended to permit the sling to be used in lifting a heavy object, the sling further having an opposed pair of spaced apart surfaces extending between the eyes and an opposed pair of edges extending between and generally transversely of the opposed pair of surfaces; and a protective sleeve having a portion surrounding and covering the portion of the sling between the eyes, including the opposed surfaces and the opposed edges, said protective sleeve further having at least a pair of pockets, each of the pockets of the protective sleeve covering the opposed surfaces of the sling and an eye of the sling, the sleeve being formed from overlapped layers of a flexible material, each of said overlapped layers having an outer surface that is substantially less coarse than the material of said sling.

2. An encapsulated sling according to claim 1 wherein said sling is formed from a material which is also ultraviolet light sensitive, and wherein the flexible material of said sleeve is substantially less ultraviolet light sensitive than the material of said sling.

3. An encapsulated sling according to claim 1 wherein the flexible material of said sleeve has substantially no load bearing capability in relation to the material of said sling.

4. An encapsulated sling according to claim 3 wherein the flexible material of said sleeve is fabricated from a material that has an outer layer of a relatively smooth, polymeric material.

5. An encapsulated sling according to claim 1 wherein said sleeve is fabricated from an opposed pair of layers, each of the opposed pair of layers being formed from a flexible material, the opposed pair of layers being joined to one another over a substantial length of said sleeve extending substantially between a pair of eyes of said at least a pair of eyes along a pair of spaced apart, longitudinally extending seams, the opposed pair of edges of the sling being positioned between the longitudinally extending seams.

6. An encapsulated sling according to claim 5 wherein the longitudinally extending seams are formed by stitching and are relatively permanent.

7. An encapsulated sling according to claim 5 wherein the longitudinally extending seams are formed by hook and loop fasteners and may be readily and repeatedly opened and reclosed.

8. An encapsulated sling according to claim 1 wherein said sling comprises at least one additional eye, the at least one additional eye being positioned adjacent to one of the pair of eyes of the at least a pair of eyes and spaced the other eye of the at least a pair of eyes, and wherein the protective sleeve is provided with at least one additional pocket, said at least one additional pocket of the protective sleeve covering said at least one additional eye of said sling.

9. An encapsulated sling according to claim 6 wherein the sling is sufficiently narrow in width, wherein there is sufficient clearance between the sling and the protective sleeve, and wherein the material of the protective sleeve is sufficiently flexible to permit one of the pockets of the protective sleeve to be folded back and the sling assembled into the protective sleeve by threading it into the protective sleeve through an opening therein adjacent the location of a folded back pocket.

10. An encapsulated sling according to claim 6 where each of the pockets is formed by overlapping portions of the one of the layers along a pair of spaced apart longitudinally extending seams and further comprising:

hook and loop fastener means on the one of the layers between the overlapping portions thereof, the one of the layers being the layer which is adapted to be the layer that contacts the object to be lifted.

11. An encapsulated sling according to claim 1 wherein said sling comprises at least a pair of sling sections positioned end to end and joining means releasably joining an end of each of the sling sections to the adjacent end of the adjacent sling section, and wherein said protective sleeve comprises at least a pair of protective sleeve sections positioned end to end, each protective sleeve section surrounding and substantially enclosing said portion of at least one of the sling sections, and further comprising:

slidable sleeve means slidable along said sling to surround and cover a juncture between the joined ends of said sling sections, said slidable covering means further surrounding and being slidable along said protective sleeve away from the juncture to permit the joined ends of the joined sling sections to be unjoined.

12. An encapsulated sling according to claim 11 wherein said end of each adjacent pair of sleeve sections comprises a flap positioned along one of the surfaces of the sling and extending toward the other adjacent sleeve section, each flap being foldable away from the sling, the flaps of said pair of sleeve sections being positioned along opposed surfaces of said sling, and wherein said slidable sleeve is slidable to surround the flaps of said pair of sleeve sections to prevent said flaps from folding away from said sling during the use of said sling.

13. A protected sling comprising:

a sling formed from a relatively coarse load bearing material and having a pair of spaced apart eyes by which the sling may be suspended to permit the sling to be used in lifting a heavy object, the sling having an object contacting surface which is adapted to face the object being lifted, an opposed surface and an opposed pair of edges, and a protective sheet covering the object contacting surface between the pair of spaced apart eyes of the sling so that substantially no portion of the length of the object contacting surface of the sling between the pair of spaced apart eyes is uncovered, said sheet being removably affixed to said sling to permit periodic inspection of said sling and being formed from a flexible material which has a load facing surface that is substantially less coarse than the material of said sling, and wherein said sling comprises at least a pair of sling sections positioned end to end and joining means releasably joining an end of each sling section to the adjacent end of the adjacent sling section, and wherein said protective sheet comprises at least a pair of protective sheet sections positioned end to end, each protective sheet section substantially covering the object contacting surface of one of said sling sections, and further comprising:

slidable covering means slidable along said sling to cover the object contacting surface of said sling at a juncture between the joined ends of said sling sections, said slidable covering means further being slidable away from the juncture to permit the joined ends of the joined sling sections to be unjoined.

* * * * *